US005646652A

United States Patent [19]

Saidi

[11] Patent Number: 5,646,652

[45] Date of Patent: Jul. 8, 1997

[54] METHOD AND APPARATUS FOR REDUCING MEMORY REQUIREMENTS IN A REDUCED LINE ACTIVE ADDRESSING DISPLAY SYSTEM

[75] Inventor: Ali Saidi, Boynton Beach, Fla.

[73] Assignee: Motorola, Inc., Schaumburg, Ill.

[21] Appl. No.: 627,235

[22] Filed: Apr. 1, 1996

Related U.S. Application Data

[63] Continuation of Ser. No. 320,771, Oct. 11, 1994, abandoned, which is a continuation of Ser. No. 103,660, Aug. 9, 1993, abandoned.

[51] Int. Cl.[6] ..... G09G 5/00

[52] U.S. Cl. ..... 345/208; 345/94; 345/100

[58] Field of Search ..... 345/87, 94, 95, 345/96, 97, 98, 99, 100, 103, 208, 209, 210; 340/825.44

[56] References Cited

U.S. PATENT DOCUMENTS

| | | | |
|---|---|---|---|
| 4,845,473 | 7/1989 | Matsuhashi et al. | 345/103 |
| 4,952,036 | 8/1990 | Gulick et al. . | |
| 5,060,036 | 10/1991 | Choi . | |
| 5,512,915 | 4/1996 | Leroux | 345/103 |

FOREIGN PATENT DOCUMENTS

| | | |
|---|---|---|
| 0507061A2 | 10/1992 | European Pat. Off. . |
| 645473 | 9/1984 | Switzerland . |

OTHER PUBLICATIONS

Kmer, A., Nehrig J. "Ultimate Limits for RMS Matrix Processing" Symp. Physics & Chemistry of Liquid Crystal Devices. 1980.

Ruckmongathan, T.N. "A Generalized Addressing Technique for RMS Responding Matrix LCD's" 1988 IDR Conference, pp. 80–85.

Terry Scheffer and Jurgen Nehring, "Supertwisted Nematic (STN) LCDs," May 17, 1992, paper submitted to 1992 SID International Symposium, Boston, Massachusetts.

Related European Patent Application o.92102353.7, filed Feb. 12, 1992 by Scheffer et al.

*Primary Examiner*—Xiao Wu

*Attorney, Agent, or Firm*—Kelly A. Gardner

[57] ABSTRACT

A data communication receiver (605) receives and stores a set of image data and displays images associated therewith on a display (600') having rows divided into first and second segments (705, 710). The data communication receiver (605) comprises a database (635) for storing a set of orthonormal functions and row drivers (650) coupled to the database (635) for driving the first segment (705) of the display (600') with first voltages associated with a first subset of orthonormal functions and driving the second segment (710) of the display (600') with second voltages associated with a remaining function included in the set of orthonormal functions during a first plurality of sequential time slots. The row drivers (650) also drive the first segment (705) with the second voltages associated with the remaining function and drive the second segment (710) with the first voltages associated with the first subset of orthonormal functions during a second plurality of sequential time slots.

22 Claims, 9 Drawing Sheets

$$\begin{bmatrix} 1 & 1 & 1 & 1 & 1 & 1 & 1 & 1 \\ 1 & 1 & 1 & 1 & -1 & -1 & -1 & -1 \\ 1 & 1 & -1 & -1 & -1 & -1 & 1 & 1 \\ 1 & 1 & -1 & -1 & 1 & 1 & -1 & -1 \\ 1 & -1 & -1 & 1 & 1 & -1 & -1 & 1 \\ 1 & -1 & -1 & 1 & -1 & 1 & 1 & -1 \\ 1 & -1 & 1 & -1 & -1 & 1 & -1 & 1 \\ 1 & -1 & 1 & -1 & 1 & -1 & 1 & -1 \end{bmatrix}$$

300

400

METHOD AND APPARATUS FOR REDUCING MEMORY REQUIREMENTS IN A REDUCED LINE ACTIVE ADDRESSING DISPLAY SYSTEM

This is a continuation of application Ser. No. 08/320,771, filed Oct. 11, 1994, and now abandoned, which is a continuation of application Ser. No. 08/103,660, filed Aug. 9, 1993, now abandoned.

FIELD OF THE INVENTION

This invention relates in general to addressing methods for addressing displays, and more specifically to a method and apparatus for reducing memory requirements in active-addressed displays.

BACKGROUND OF THE INVENTION

An example of a direct multiplexed, rms (root mean square) responding electronic display is the well-known liquid crystal display (LCD). In such a display, a nematic liquid crystal material is positioned between two parallel glass plates having electrodes applied to each surface in contact with the liquid crystal material. The electrodes typically are arranged in vertical columns on one plate and horizontal rows on the other plate for driving a picture element (pixel) wherever a column and row electrode overlap.

In rms-responding displays, the optical state of a pixel is substantially responsive to the square of the voltage applied to the pixel, i.e., the difference in the voltages applied to the electrodes on the opposite sides of the pixel, LCDs have an inherent time constant that characterizes the time required for the optical state of a pixel to return to an equilibrium state after the optical state has been modified by changing the voltage applied to the pixel. Recent technological advances have produced LCDs with time constants (approximately 16.7 milliseconds) approaching the frame period used in many video displays. Such a short time constant allows the LCD to respond quickly and is especially advantageous for depicting motion without noticeable smearing or flickering of the displayed image.

Conventional direct multiplexed addressing methods for LCDs encounter a problem when the display time constant approaches the frame period. The problem occurs because conventional direct multiplexed addressing methods subject each pixel to a short duration "selection" pulse once per frame. The voltage level of the selection pulse is typically 7–13 times higher than the rms voltages averaged over the frame period. The optical state of a pixel in an LCD having a short time constant tends to return towards an equilibrium state between selection pulses, resulting in lowered image contrast, because the human eye integrates the resultant brightness transients at a perceived intermediate level. In addition, the high level of the selection pulse can cause alignment instabilities in some types of LCDs.

To overcome the above-described problems, an "active addressing" method for driving rms responding electronic displays has been developed. The active addressing method continuously drives the row electrodes with signals comprising a train of periodic pulses having a common period T corresponding to the frame period. The row signals are independent of the image to be displayed and preferably are orthogonal and normalized, i.e., orthonormal. The term "orthogonal" denotes that, if the amplitude of a signal applied to one of the rows is multiplied by the amplitude of a signal applied to another one of the rows, the integral of this product over the frame period is zero. The term "normalized" denotes that all the row signals have the same rms voltage integrated over the frame period T.

During each frame period a plurality of signals for the column electrodes are calculated and generated from the collective state of the pixels in each of the columns. The column voltage at any time t during the frame period is proportional to the sum obtained by considering each pixel in the column, multiplying a "pixel value" representing the optical state (either −1 for fully "on", +1 for fully "off", or values between −1 and +1 for proportionally corresponding gray shades) of the pixel by the value of that pixel's row signal at time t, and adding the products obtained thereby to the sum. In effect, the column voltages can be derived by transforming each column of a matrix of incoming image data by the orthonormal signals utilized for driving the rows of the display.

If driven in the active addressing manner described above, it can be shown mathematically that there is applied to each pixel of the display an rms voltage averaged over the frame period, and that the rms voltage is proportional to the pixel value for the frame. The advantage of active addressing is that it restores high contrast to the displayed image because, instead of applying a single, high level selection pulse to each pixel during the frame period, active addressing applies a plurality of much lower level (2–5 times the rms voltage) selection pulses spread throughout the frame period. In addition, the much lower level of the selection pulses substantially reduces the probability of alignment instabilities. As a result, utilizing an active addressing method, rms responding electronic displays, such as LCDs utilized in portable radio devices, can display image data at video speeds without smearing or flickering. Additionally, LCDs driven with an active addressing method can display image data having multiple shades without the contrast problems present in LCDs driven with conventional multiplexed addressing methods.

A drawback to utilizing active addressing results from the large number of calculations required to generate column and row signals for driving an rms-responding display and the large amount of memory required for storage of the signals. For example, a display having 480 rows and 640 columns requires approximately 230, 400 (#rows$^2$) operations simply for generation of the column values for a single column during one frame period. While it is, of course, possible to perform calculations at this rate, such complex, rapidly performed calculations necessitate a large amount of power consumption. Therefore, a method referred to as "reduced line addressing" has been developed.

In reduced line addressing, the rows of a display are evenly divided and addressed separately. If, for instance, a display having 480 rows and 640 columns is utilized to display image data, the display could be divided into eight groups of sixty (60) roves, which are each addressed for ⅛ of the frame time, thus requiring only 60 (rather than 480) orthonormal signals for driving the rows. In operation, columns of an orthonormal matrix, which is representative of the orthonormal signals, are applied to rows of the different segments during different time periods. During the different time periods, the columns of the display are driven with rows of a "transformed image data matrix", which is representative of the image data which has been previously transformed, as described above, utilizing the orthonormal signals. In reduced line addressing, however, the transformed image data matrix can be transformed using the smaller set of orthonormal signals, i.e., using 60 orthonormal signals rather than 480 orthonormal signals. More specifically, the image data matrix is divided into segments of 60 rows, and each segment is transformed in an independent transformation using the 60 orthonormal signals to generate the transformed image data matrix.

Using the reduced line addressing method as described, approximately 3,600, i.e., $60^2$ operations are required for generation of the column voltages for a single column during each segment time. Because the frame period has been divided into eight segments, the total number of operations for generation of the column voltages for a single column during the frame period is approximately 28, 800, i.e., 8 * 3,600. Therefore, in the above-described example, generating column values for driving a single column of a 480×640 display over an entire frame period using reduced line addressing requires only an eighth of the operations necessary for column voltage generation when the display is addressed as a whole. It will be appreciated that the reduced line addressing method therefore necessitates less power and less time for performance of the required operations.

However, because the signals for driving the rows and columns of the display are distributed in time when reduced line addressing is used, all of the column signals for driving the columns of the display over an entire frame period must be derived and stored in memory prior to driving the display. Therefore, depending upon the size of the display, the amount of memory required for storage of the signals can be quite large, and the memory requirements are not reduced from the requirements of conventional active addressing techniques. In fact, in some chips currently used for driving displays using active addressing techniques, the memory required for calculation and storage of the column signals can consume up to 90% of the chip.

Thus, what is needed is method and apparatus for reducing the amount of memory required for derivation and storage of column signals for driving columns of an active-addressed display.

SUMMARY OF THE INVENTION

A method for driving a display, rows of which are divided into at least first and second segments, comprises the step of driving, during a first plurality of sequential time slots, a first plurality of rows included in the first segment with first voltages associated with a first subset of functions included in a complete set of orthonormal functions. The method further comprises the step of driving, during the first plurality of sequential time slots, a second plurality of rows included in the second segment with second voltages associated with a remaining function included in the complete set of orthonormal functions, wherein the remaining function is not included in the first subset of functions.

A data communication receiver receives and stores a set of image data and displays images associated therewith on a display having rows divided into first and second segments. The data communication receiver comprises a database for storing a set of orthonormal functions and row drivers coupled to the database for driving the first segment of the display with first voltages associated with a first subset of orthonormal functions and driving the second segment of the display with second voltages associated with a remaining function included in the set of orthonormal functions during a first plurality of sequential time slots. The row drivers also drive the first segment with the second voltages associated with the remaining function and drive the second segment with the first voltages associated with the first subset of orthonormal functions during a second plurality of sequential time slots.

DESCRIPTION OF A PREFERRED EMBODIMENT

Figure 1:
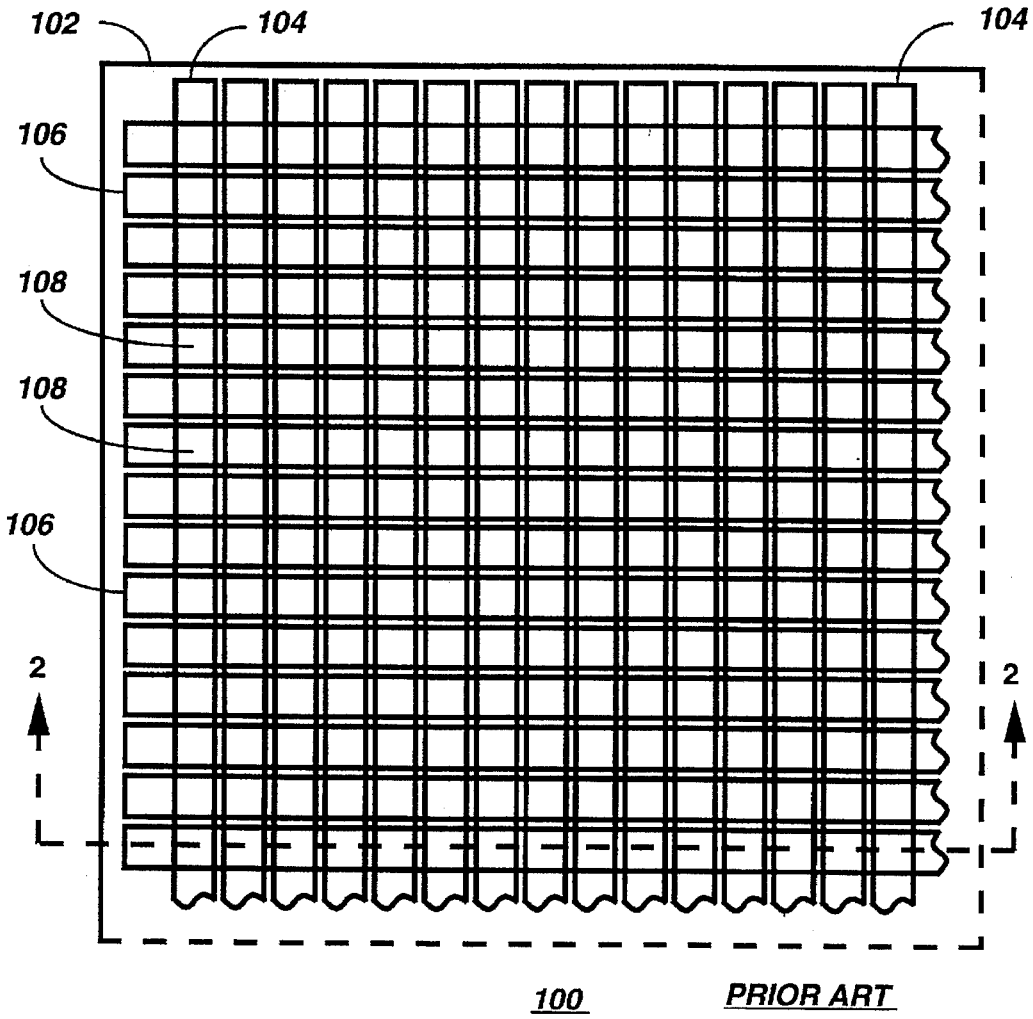
FIG. 1 is a front orthographic view of a portion of a conventional liquid crystal display.
Figure 2:
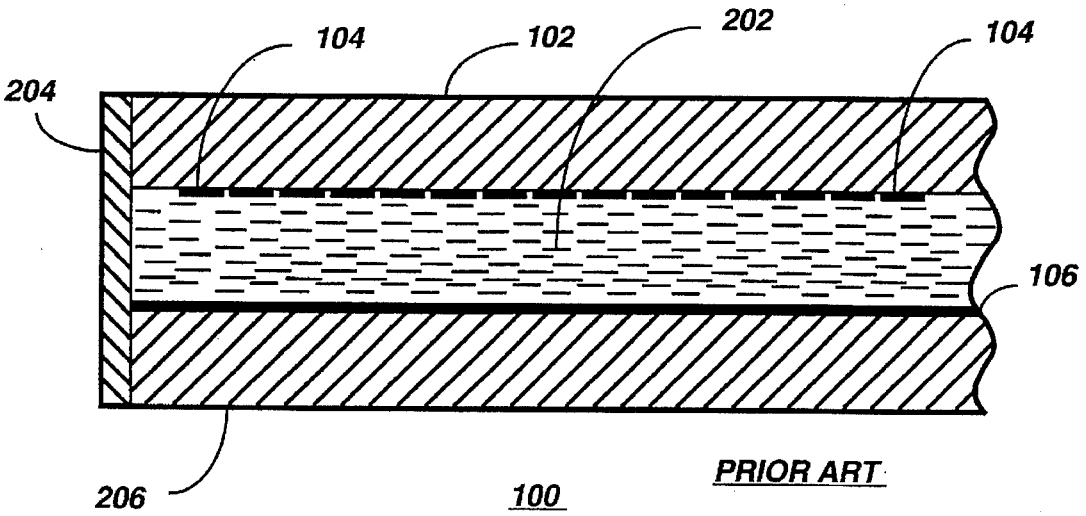
FIG. 2 is an orthographic cross-section view along the line 2—2 of FIG. 1 of the portion of the conventional liquid crystal display.

Referring to FIGS. 1 and 2, orthographic front and cross-section views of a portion of a conventional liquid crystal display (LCD) 100 depict first and second transparent substrates 102, 206 having a space therebetween filled with a layer of liquid crystal material 202. A perimeter seal 204 prevents the liquid crystal material from escaping from the LCD 100. The LCD 100 further includes a plurality of transparent electrodes comprising row electrodes 106 positioned on the second transparent substrate 206 and column electrodes 104 positioned on the first transparent substrate 102. At each point at which a column electrode 104 overlaps a row electrode 106, such as the overlap 108, voltages applied to the overlapping electrodes 104, 106 can control the optical state of the liquid crystal material 202 therebetween, thus forming a controllable picture element, hereafter referred to as a "pixel". While an LCD is the preferred display element in accordance with the preferred embodiment of the present invention, it will be appreciated that other types of display elements may be used as well, provided that such other types of display elements exhibit optical characteristics responsive to the square of the voltage applied to each pixel, similar to the root mean square (rms) response of an LCD.

Figures 3, 4:
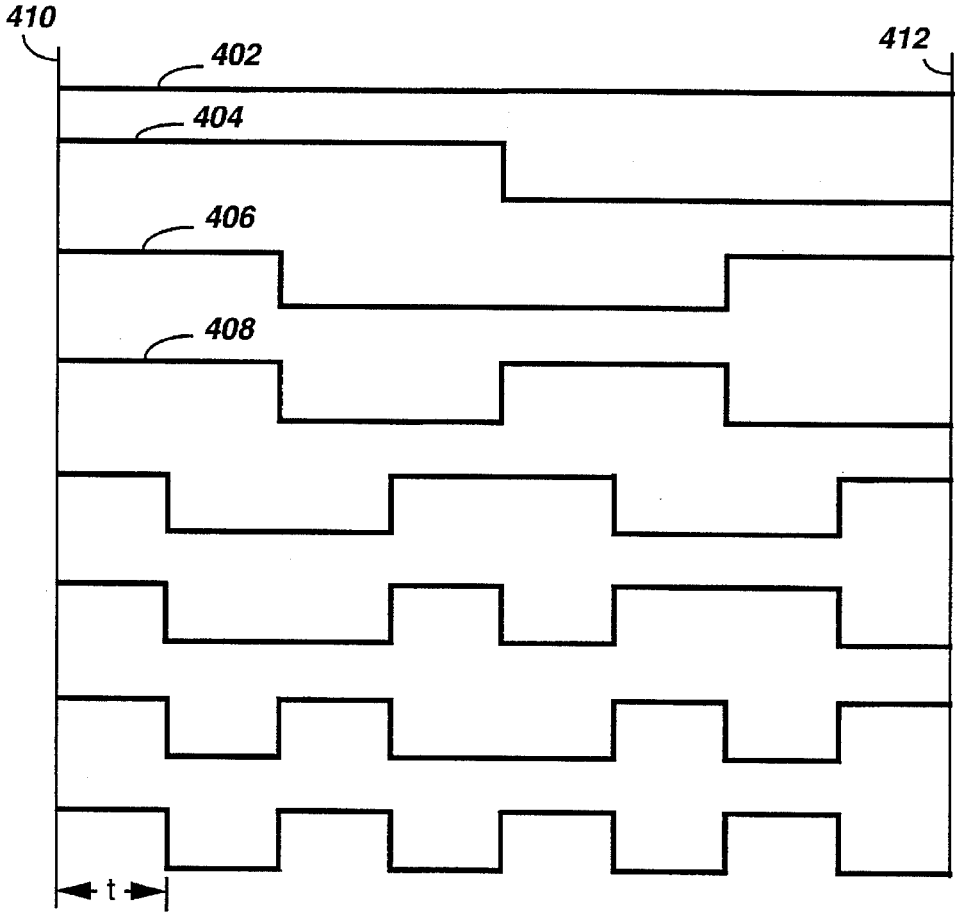
FIG. 3 is a matrix of Walsh functions in accordance with the present invention.
FIG. 4 depicts drive signals corresponding to the Walsh functions of FIG. 3 in accordance with the present invention.

Referring to FIGS. 3 and 4, an eight-by-eight (third order) matrix of Walsh functions 300 and the corresponding Walsh waves 400 in accordance with the preferred embodiment of the present invention are shown. Walsh functions are both orthogonal and normalized, i.e., orthonormal, and are therefore preferable for use in an active-addressed display system, as briefly discussed in the Background of the Invention herein above. It may be appreciated by one of ordinary skill in the art that other classes of functions, such as Pseudo Random Binary Sequence (PRBS) functions or Discrete Cosine Transform (DCT) functions, may also be utilized in active-addressed display systems.

When Walsh functions are used in an active-addressed display system, voltages having levels represented by the Walsh waves 400 are uniquely applied to a selected plurality of electrodes of the LCD 100. For example, the Walsh waves 404, 406, and 408 could be applied to the first (uppermost), second and third row electrodes 106, respectively, and so on. In this manner, each of the Walsh waves 400 would be applied uniquely to a corresponding one of the row electrodes 106. It is preferable not to use the Walsh wave 402 in an LCD application because the Walsh wave 402 would bias the LCD 100 with an undesirable DC voltage.

It is of interest to note that the values of the Walsh waves 400 are constant during each time slot t. The duration of the time slot t for the eight Walsh waves 400 is one-eighth of the duration of one complete cycle of Walsh waves 400 from start 410 to finish 412. When using Walsh waves for actively addressing a display, the duration of one complete cycle of the Walsh waves 400 is set equal to the frame duration, i.e., the time to receive one complete set of data for controlling all the pixels 108 of the LCD 100. The eight Walsh waves 400 are capable of uniquely driving up to eight row electrodes 106 (seven if the Walsh wave 402 is not used). It will be appreciated that a practical display has many more rows. For example, displays having four-hundred-eighty (480) rows and six-hundred-forty (640) columns are widely used today in laptop computers. Because Walsh function matrices are available in complete sets determined by powers of two, and because the orthonormality requirement for active addressing does not allow more than one electrode to be driven from each Walsh wave, a five-hundred-twelve by five-hundred-twelve ($2^9 \times 2^9$) Walsh function matrix would be required to drive a display having four-hundred-eighty row electrodes 106. For this case, the duration of the time slot t is 1/512 of the frame duration. Four-hundred-eighty Walsh waves would be used to drive the four-hundred-eighty row electrodes 106, while the remaining thirty-two, preferably including the first Walsh wave 402 having a DC bias, would be unused.

The columns of the LCD 100 are, at the same time, driven with column voltages derived by transforming the image data, which can be represented by a matrix of image data values, utilizing orthonormal functions representative of the Walsh waves 400. This transformation can be accomplished, for example, by using matrix multiplication, Walsh Transforms, modifications of Fourier Transforms, or other such algorithms. In accordance with active addressing methods, the rms voltage applied to each of the pixels of the LCD 100 during a frame duration approximates an inverse transformation of the column voltages, thereby reproducing the image data on the LCD 100.

Figure 5:
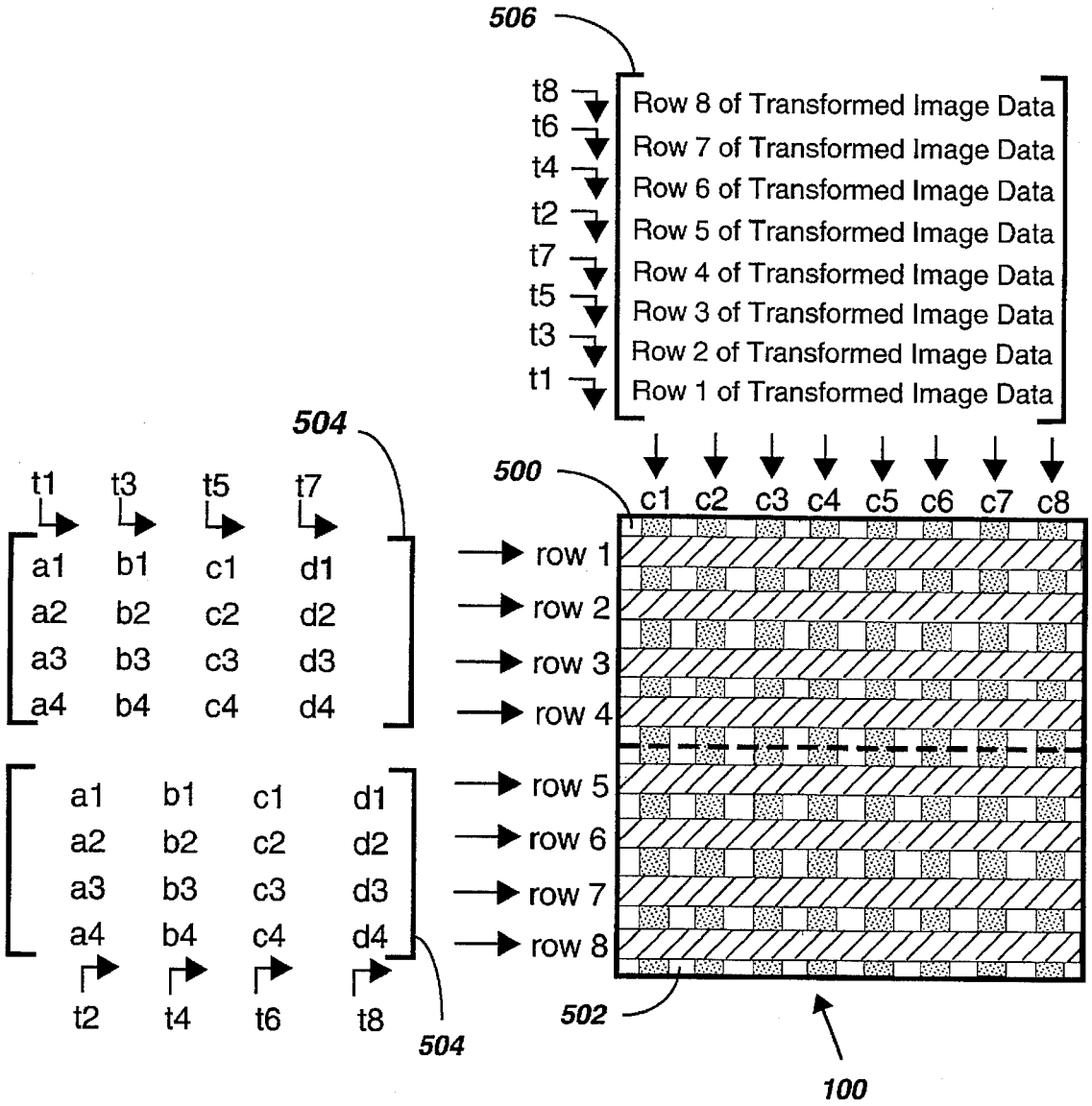
FIG. 5 PRIOR ART
FIG. 5 is a front orthographic view of a conventional liquid crystal display which is divided into segments that are addressed in accordance with conventional reduced line addressing techniques.

Referring next to FIG. 5, an illustration depicts a conventional active-addressed LCD, such as the LCD 100, which is driven in accordance with reduced line addressing techniques, thereby reducing the power necessary for driving the LCD 100, as described briefly hereinabove in the Background of the Invention. As shown, the LCD 100 is divided into segments, each of which comprises an equal number of rows. For illustrative purposes only, the LCD 100 is depicted as having only eight columns and eight rows, which are evenly divided into two segments 500, 502 of four rows each. The two segments 500, 502 are addressed separately using matrices of orthonormal functions, such as Walsh functions. Because each segment 500, 502 comprises only four rows, the matrix 504 used for driving each segment 500, 502 need only include four orthonormal functions having four values each. Additionally, the orthonormal matrix 504 is used for transforming the image data, which is preferably in the form of an image data matrix. For the current example, in which an eight-by-eight LCD 100 is divided into two segments 500, 502, the orthonormal function matrix 504 is used first to transform the first four rows of the image data matrix, and then to transform the second four rows of the image data, thereby generating an entire transformed image data matrix 506, which includes column values for driving columns of the LCD 100 during the frame duration.

In operation, row drivers (not shown) are employed to drive, during a first time period, the first four rows of the LCD 100 with row voltages associated with the values in the first column of the orthonormal matrix 504. For instance, during the first time period, row 1 is driven with voltage a1, row 2 is driven with voltage a2, row 3 is driven with voltage a3 and row 4 is driven with voltage a4. At the same time, the columns are driven with voltages associated with values included in the first row of the transformed image data matrix 506. During the second time period, the second four rows of the LCD 100 are driven with row voltages associated with the values in the first column of the orthonormal matrix 504. Specifically, row 5 is driven with voltage a1, row 6 is driven with voltage a2, row 7 is driven with voltage a3, and row 8 is driven with voltage a4. At the same time, the columns of the LCD 100 are driven with voltages associated with values included in the fifth row of the transformed image data matrix 506, as shown. During the third time period, the first four rows of the LCD 100 are again driven, this time with row voltages associated with the values in the second column of the orthonormal matrix 504. Simultaneously, the columns are driven with voltages associated with values included in the second row of the transformed image data matrix 506. This operation continues until, after eight time periods, the rows of each of the segments have been addressed with all of the columns of the orthonormal matrix 504, and the columns of the LCD 100 have been addressed with all of the rows of the transformed image data matrix 506.

In reduced line addressing, the number of operations necessary for driving the columns of a display is greatly reduced when compared to the number necessary when an entire display is addressed as a whole. Therefore, reduced line addressing requires less power consumption than conventional active addressing. However, the memory requirements for reduced line addressing are quite large because all of the column signals, i.e., the entire transformed image data matrix 506, must be derived and stored prior to addressing the LCD 100. For a small display, the storage of all of the column signals may not consume too much space, but, for larger displays, the storage of the column signals can easily consume up to 90% of a chip which generates the column signals. As a result, an electronic device utilizing a display which is driven using conventional reduced line addressing techniques must be large enough to accommodate not only sufficient memory for storage of operating parameters and subroutines, but also all of the column signals for addressing the entire display during an entire frame duration.

Figure 6:
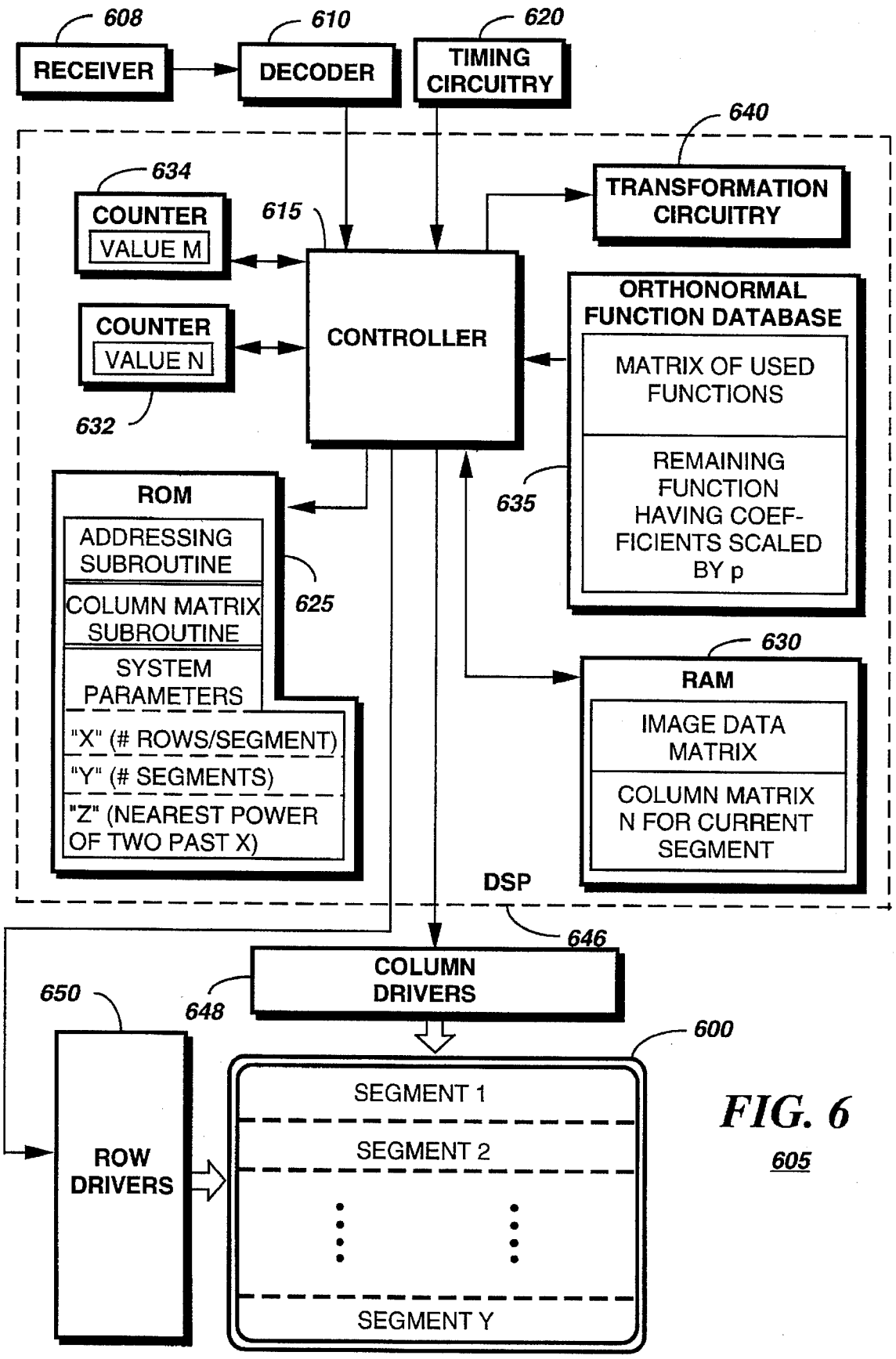
FIG. 6 is an electrical block diagram of an electronic device comprising a liquid crystal display which is addressed in accordance with the present invention.

FIG. 6 is an electrical block diagram of art electronic device which receives and displays image data on an LCD 600, the rows of which are divided into segments such that the LCD 600 can be addressed in accordance with the present invention, thereby saving memory and power necessary for computation and storage of column values. When the electronic device is a radio communication device 605, as shown, the image data to be displayed on the LCD 600 is included in a radio frequency signal, which is received and demodulated by a receiver 608 internal to the radio communication device 605. A decoder 610 coupled to the receiver 608 decodes the radio frequency signal to recover the image data therefrom in a conventional manner, and a controller 615 coupled to the decoder 610 further processes the image data.

Coupled to the controller 615 is timing circuitry 620 for establishing system timing. The timing circuitry 620 can, for example, comprise a crystal (not shown) and conventional oscillator circuitry (not shown). Additionally, a memory, such as a read only memory (ROM) 625, stores system parameters and system subroutines which are executed by the controller 615. The system parameters can include, for example, the number y of segments into which the LCD 600 is divided, the number x of rows included in each segment, and z, the nearest power of two greater than x. The subroutines can include, for example, a column matrix subroutine performed to generate column values for addressing columns of the LCD 600 and an addressing subroutine performed to address both the columns and the rows of the LCD 600. A random access memory (RAM) 630, also coupled to the controller 615, is employed to store the incoming image data as an image data matrix and to temporarily store other variables, such as the generated column values in the form of a column matrix for each segment, derived during operation of the radio communication device 605. Additionally, counters 632, 634 coupled to the controller 615 store counter values which are incremented during the addressing of the LCD 600.

Preferably, the radio communication device 605 further comprises an orthonormal matrix database 635 for storing a set of orthonormal functions in the form of a matrix. The orthonormal functions can be, as described above, Walsh functions, DCT functions, or PRBS functions, the number of which must be greater than the number of rows included in each segment of the LCD 600. In accordance with the present invention, the number of rows included in each segment of the LCD 600 is not equal to a power of two, thereby ensuring that, when Walsh functions are utilized, the number of Walsh functions is greater than the number of rows included in each segment because Walsh function matrices are available in complete sets determined by powers of two.

Preferably, the set of orthonormal functions are separated into a set of "used" functions, stored in the form of a "used function" matrix for addressing some segments of the LCD 600, and a remaining, or leftover, function for addressing other segments of the LCD 600, as will be described in detail below. The used function matrix preferably includes a number of orthonormal functions equal to the number x of rows per segment, and the remaining orthonormal function is a leftover orthonormal function not included in the used function matrix. In accordance with the preferred embodiment of the present invention, coefficients of the remaining function are divided by a scaling factor p, which is determined by the number of rows in the LCD 600 and the number of segments into which the LCD 600 is divided. Alternatively, rather than scaling the remaining function before storage in the database 635, the remaining function could be stored in an unsealed form, then simply scaled by the controller 615 before use. However, because it is not anticipated that the size of the LCD 600 or the number of segments included therein will change during use of the LCD 600, time can be saved by scaling coefficients of the remaining function before storage.

The scaling factor p is utilized to adjust a "selection ratio" of the LCD 600. As is well known to one of ordinary skill in the art, the selection ratio determines the contrast of the displayed image. The maximum possible selection ratio is obtained by driving a display with conventional active addressing techniques and is given by the formula:

$$R=\sqrt{\frac{\sqrt{N}+1}{\sqrt{N}-1}},$$

where R is the selection ratio and N is the number of rows included in the display. It can be seen that for a display having two-hundred-forty (240) rows and driven with conventional active addressing techniques, the selection ratio is equal to 1.06677.

In accordance with the preferred embodiment of the present invention, the selection ratio is further dependent upon the number of segments into which the LCD 600 is divided and the scaling factor p with which coefficients of the remaining function are divided. The selection ratio for a display driven in accordance with the present invention is given by the formula:

$$R=\sqrt{\frac{y+1+\frac{(y-1)}{p^2}+\frac{2}{\sqrt{x}}}{y+1+\frac{(y-1)}{p^2}-\frac{2}{\sqrt{x}}}},$$

where R is the selection ratio, y is the number of segments into which the display is divided, x is the number of rows included in each segment, and p is the scaling factor. For an acceptable contrast, the selection ratio is preferably greater than 1.045. Therefore, since the number of segments and the number of rows in each segment are known, the scaling factor p can be chosen appropriately such that the selection ratio is greater than 1.045. By way of example, for a display having two-hundred-forty (240) rows divided into eight (8) segments of thirty (30) rows each, the selection ratio is equal to 1.04092 if the scaling factor is chosen to be eight (8), i.e., R=1.04092 for p=8. For this display, then, the remaining function stored in the RAM 630 would be a leftover orthonormal function, the coefficients of which are divided by eight. It will be appreciated that, in some circumstances, the scaling factor p can be equal to one (1) and still result in a selection ratio greater than 1.045.

Further included in the radio communication device 605 is transformation circuitry 640 for generating column values for addressing the columns of the LCD 600 in accordance with the preferred embodiment of the present invention. The transformation circuitry 640, which is coupled through the controller 615 to the orthonormal function database 635, transforms subsets of the image data utilizing the orthonormal functions included in the used function matrix, thereby generating a set of column values, which is stored in the RAM 630 as a column matrix. It will be appreciated by one of ordinary skill in the art that, because the number of functions in a complete set of orthonormal functions is greater than the number of rows in each LCD segment, the same column values would result if the entire set of orthonormal functions, rather than the set of used functions, were used for transforming the subsets of the image data.

According to the present invention, the subsets of the image data are rows of the image data matrix which correspond to the rows included in the segments of the LCD 600, as will be explained in greater detail below.

Preferably, the transformation circuitry 640 transforms the subsets of the image data using an algorithm such as a Fast Walsh Transform, a modification of a Fast Fourier Transform, or matrix multiplication. When matrix multiplication is employed, the transformation can be approximated by the following formula:

$$CV=OM * ID,$$

wherein ID represents the subset of image data to be transformed, OM represents a matrix formed from the orthonormal functions (either the entire set or the used functions), and CV represents the column values generated by the multiplication of the subset of the image data and the orthonormal functions.

For the LCD 600 having y segments comprising x rows each, the frame duration is divided into y time periods, hereafter referred to as segment times. Prior to the first segment time, rows of the image data matrix which correspond to the rows in the first LCD segment are transformed using either the used functions only or the entire set of orthonormal functions to generate transformed image data which is stored in the form of a column matrix. During the first segment time, the columns of the LCD 600 are driven with voltages associated with the values in the column matrix. At the same time, the rows included in the first segment are driven with voltages associated with the functions included in the used function matrix, and all other rows are driven with voltages associated with the scaled, remaining function. Prior to the second segment time, rows of the image data matrix which correspond to the rows in the second LCD segment are transformed using the chosen orthonormal functions, i.e., the used functions or the entire set, and stored as a second column matrix. At this point, the previous column matrix can be conveniently discarded from the RAM 630, thereby saving memory space. During the second segment time, the columns of the LCD 600 are driven with voltages associated with the values in the second column matrix which is now stored in the RAM 630. At the same time, the rows included in the second segment are driven with the voltages associated with the used functions, and all other rows are driven with the voltages associated with the scaled, remaining function. This operation continues until all segments of the LCD 600 have been addressed as described.

According to the present invention, further coupled to the controller 615 are column drivers 648 for driving the columns of the LCD 600 with voltages associated with the column values provided thereto by the controller 615. Additionally, row drivers 650 coupled to the controller 615 receive the orthonormal functions and the scaled, remaining function therefrom and drive the rows of the LCD 600 with the appropriate voltages.

It will be recognized that the controller 615, the ROM 625, the RAM 630, the counters 632, 634, the orthonormal matrix database 635, and the transformation circuitry 640 can be implemented by a digital signal processor (DSP) 646, such as the DSP56000 manufactured by Motorola, Inc. However, in alternate embodiments of the present invention, the listed elements can be implemented using hard-wired logic capable of performing equivalent operations. The column drivers 648 can be implemented using model no. SED1779DOA column drivers manufactured by Seiko Epson Corporation, and the row drivers 650 can be implemented using model no. SED1704 row drivers, also manufactured by Seiko Epson Corporation. Other row drivers and column drivers which operate in a similar manner may be utilized as well.

Figure 7:
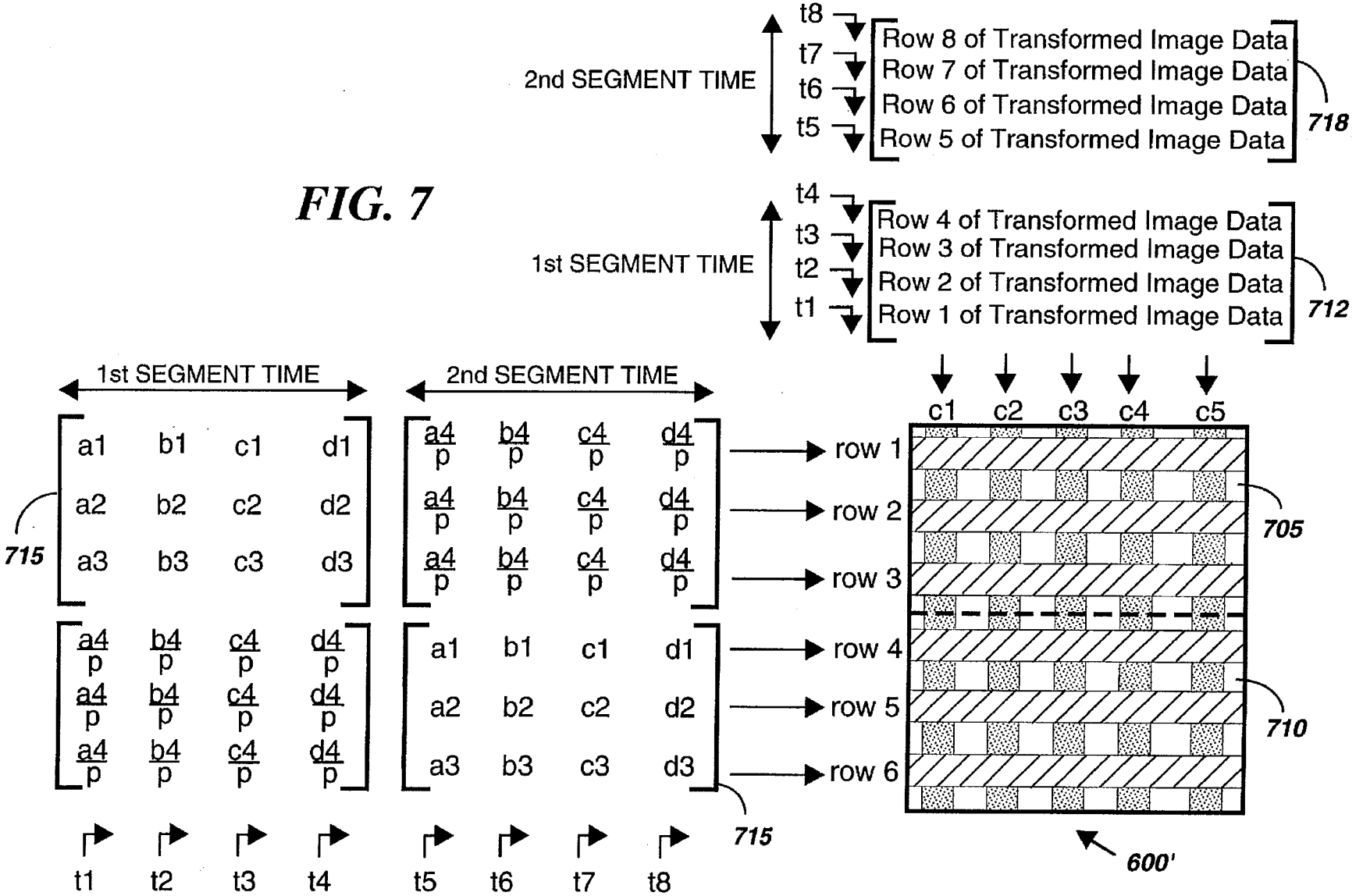
FIG. 7 depicts column matrices associated with column voltages and row matrices associated with row voltages for driving a liquid crystal display having two segments which are addressed in accordance with the present invention.

Referring next to FIG. 7, matrices associated with voltages used in addressing an LCD 600' are depicted. For illustrative purposes only, the LCD 600' is shown as including two segments 705, 710 having three rows each. During the first segment time, the rows of the first segment 705 are addressed with voltages associated with the used function matrix 715. At the same time, the rows of the second segment 710 are addressed with voltages associated with the scaled, remaining function, coefficients of which are shown as a4/p, b4/p, c4/p, and d4/p. Additionally, during the first segment time, the columns of the LCD 600' are addressed with voltages associated with a first column matrix 712 having a number of rows equal to z, which is the nearest power of two greater than the number x of the rows included in each segment 705, 710 of the LCD 600'. For this example, the number of rows in the first column matrix 712 is four (4), as four (4) is the nearest power of two greater than three (3), which is the number of rows in each segment 705, 710. The first column matrix 712, as described above, has been previously calculated by transforming the first three rows of the image data matrix using the used function matrix and thereafter stored in the RAM 630.

Preferably, the first segment time is equally divided into a plurality of sequential time slots, during which successive coefficients of both the used functions and the scaled, remaining function are provided to the rows of the LCD 600'. The number of sequential time slots during each segment time is preferably equal to z, the nearest power of two greater than the number x of rows in each segment. Therefore, for this example, the number of sequential time slots in each segment time is equal to four (4). During a first time slot, the rows in the first segment 705 are addressed with the first column of the used function matrix 715. At the same time, the rows in the second segment 710 are addressed with the first scaled coefficient of the remaining function. The columns of the LCD 600' are addressed with the first row of the first column matrix 712 during the first sequential time slot. Next, during the second time slot, the rows in the first segment 705 are addressed with the second column of the used function matrix 715, and the rows in the second segment 710 are addressed with the second scaled coefficient of the remaining function. At the same time, the columns of the ICD 600' are addressed with the second row of the first column matrix 712. This operation continues until the first segment time expires, at which time the columns will have been addressed with all rows of the first column matrix 712, the rows of the first segment 705 will have been addressed with all columns of the used function matrix, and the rows of the second segment 710 will have been addressed with all coefficients of the remaining function.

Prior to the second segment time, a second column matrix 718 is generated by transforming the second three rows of the image data matrix using the used function matrix. This second column matrix 718 replaces the first column matrix 712 in the RAM 630. During the four sequential time slots of the second segment time, the columns of the LCD 600' are sequentially addressed with the four rows of the column matrix 718. The rows of the second segment 710 are sequentially addressed with the columns of the used function matrix 715, while the rows of the first segment 705 are sequentially addressed with the coefficients of the remaining function.

In this manner, only a single, reduced-size column matrix need be stored in the RAM 630 at any one time. As a result, the RAM 630 can be much smaller than in devices which utilize conventional reduced line addressing techniques. In display devices addressed with conventional reduced line addressing techniques, a column matrix for addressing the columns during the entire frame time must be calculated and stored for the entire frame time because signals derived therefrom must be distributed in time in order for the image to be displayed with acceptable contrast. Although, for the above described example, this column matrix would only encompass eight rows of transformed image data, larger displays would necessitate much more stored data. For example, a display having two-hundred-forty rows would have to store a column matrix comprising two-hundred-forty rows of transformed data for the entire frame period. It can be seen, therefore, that the addressing method according to the present invention requires the use of much less space in memory than do conventional addressing methods because the signals for addressing the LCD 600' are not distributed in time. Furthermore, this method ensures that the square of the rms voltage applied to each pixel has a linear relationship with the pixel value, as required by active addressing systems.

In some situations, such as when displaying color images, correction factors must be calculated and added to the transformed image data before addressing the columns of the display with the column matrix. These correction factors are typically calculated using a leftover orthonormal function not needed for conventionally addressing the columns. In cases where correction factors are necessary, therefore, the number of rows included in each segment of a display addressed in accordance with the present invention must be two or more integer values away from the nearest, greater power of two. For example, a display having twelve rows could be divided into two segments of six rows each, which leaves two unused orthonormal functions: one for calculation of correction factors, and one for use as the remaining function. It will be appreciated that, if correction factors are needed, this twelve-row display could not be divided into four segments of three rows each, as this would leave only a single unused, leftover orthonormal function. Circuits and techniques for the calculation and implementation of correction factors are taught in the U.S. Patent Application entitled "Method and Apparatus for Driving an Electronic Display" by Herold, Attorney's Docket No. PT00843U, which is assigned to Motorola, Inc., and which is hereby incorporated by reference.

One of ordinary skill in the art will recognize that, in an alternate embodiment of the present invention, the number of rows in each segment could be equal to a power of two. However, in this circumstance, the set of orthonormal functions would have to be increased to the next greater power of two, thereby greatly increasing the number of rows included in each column matrix. By the same token, the number of rows in each segment could be such that no additional remaining function was left available for calculation of correction factors. Again, the set of orthonormal functions could simply be increased to the next power of two in order to create "remaining" functions. This method, however, should not be used unless necessary, as it increases the amount of memory required for storage of column values during each segment time. When driving displays having larger segments, this memory increase can be quite dramatic, thereby reversing some of the advantages which occur when only one or two remaining functions are available.

Figure 8:
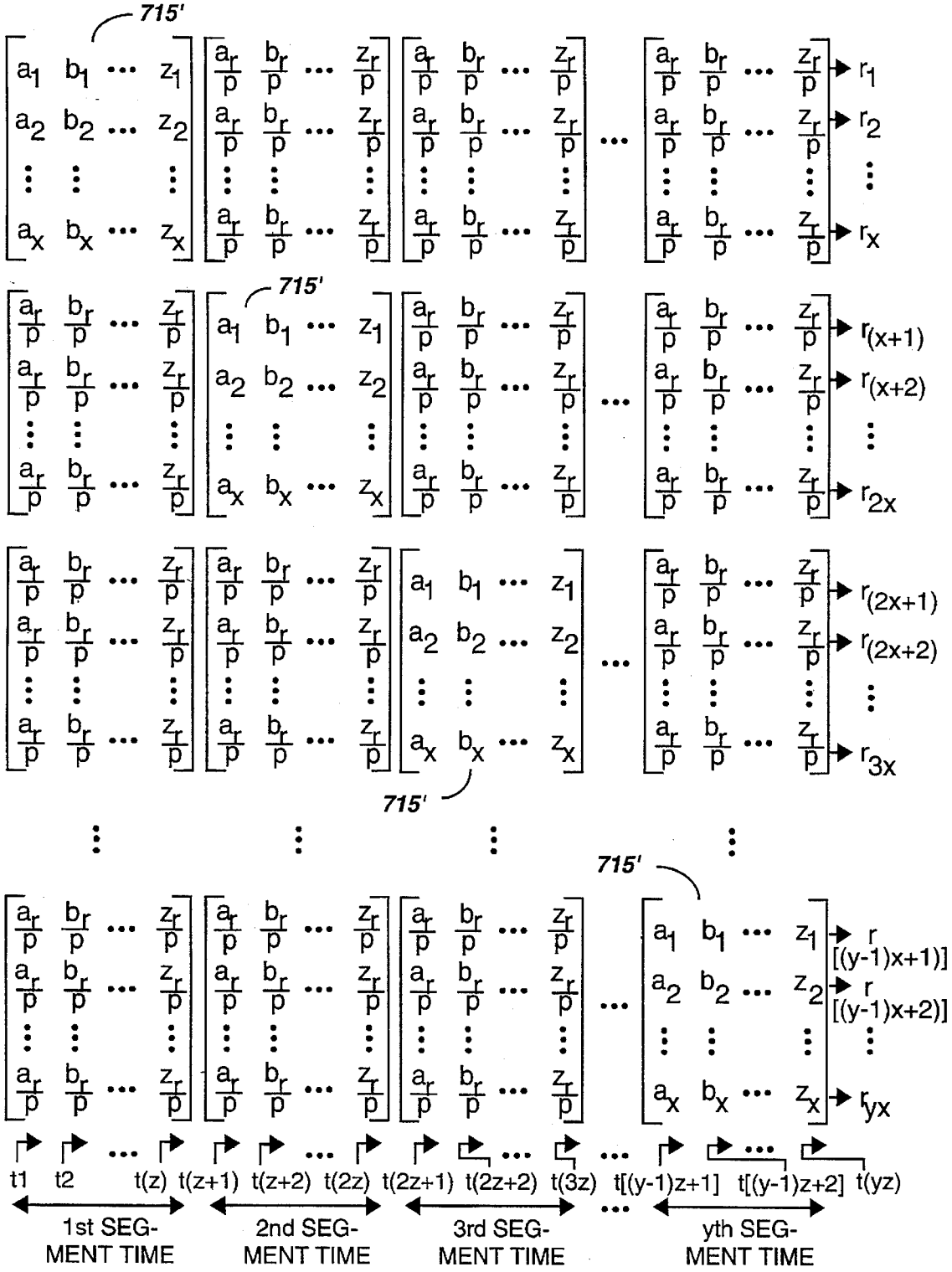
FIG. 8 depicts row matrices associated with row voltages for driving a liquid crystal display having y number of segments, each including x number of rows addressed in accordance with the present invention.
Figure 9:
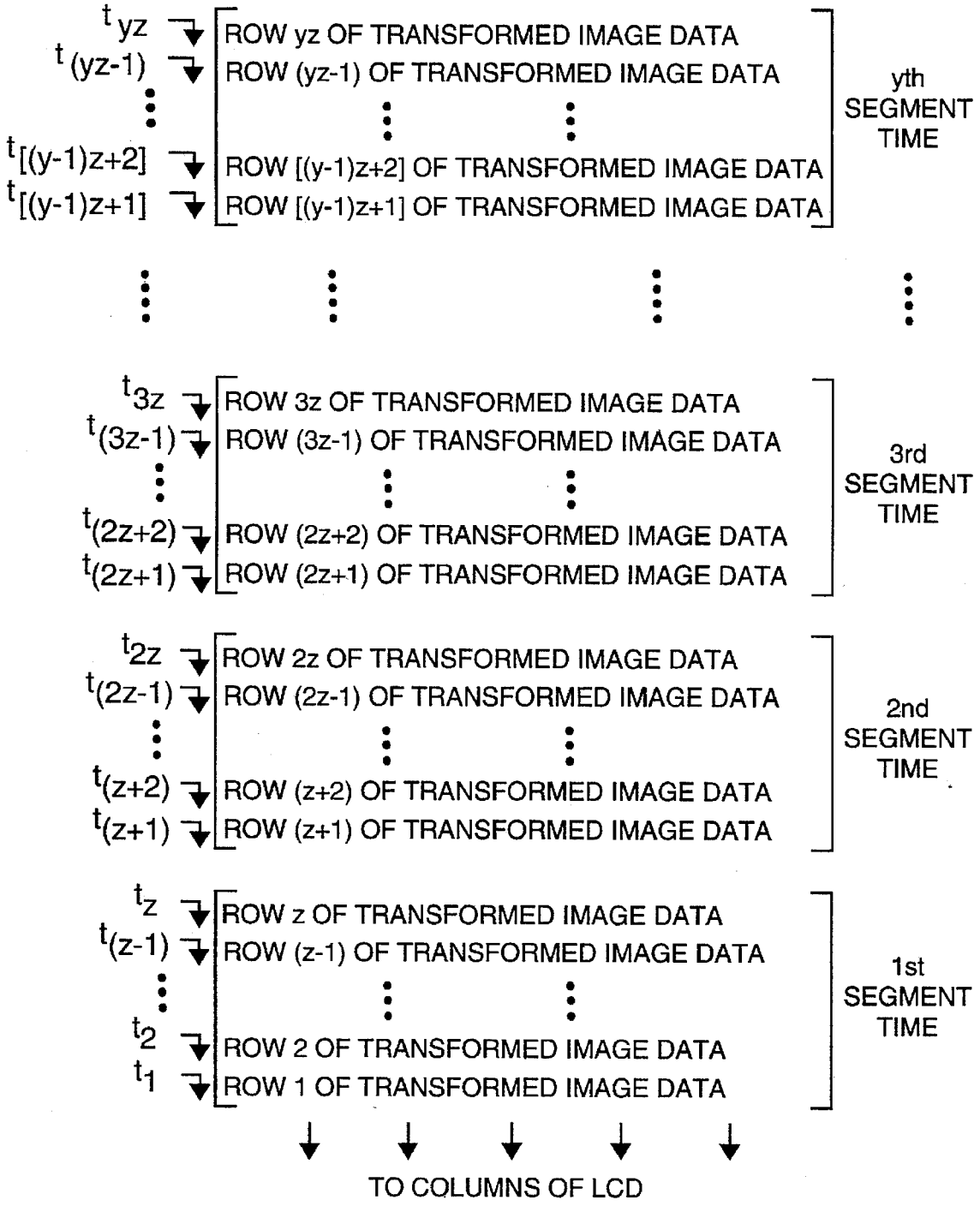
FIG. 9 depicts column matrices associated with column voltages for driving columns of a liquid crystal display in accordance with the present invention.

Referring next to FIGS. 8 and 9, matrices for driving, in accordance with the present invention, columns and rows of a display of any size are depicted. The row matrices for driving a display having y segments of x rows each, wherein z is the nearest power of two greater than x, are shown in FIG. 8. The row matrices preferably comprise a matrix of used orthonormal functions 715' for sequentially driving each successive segment of the display during successive segment times, each of which is equal to the frame duration divided by y. As can be seen, the number of orthonormal functions included in the used function matrix 715' is equal to the number of rows in each display segment. Additionally, a matrix of scaled coefficients is included in the row matrices. As described above, all rows of the display which are not included in the current segment, i.e., the segment being driven by the used function matrix 715', are driven with scaled coefficients of a remaining orthonormal function that is not included in the used function matrix 715'. The coefficients of the remaining function are preferably scaled by a scaling factor p which is chosen to result in a selection ratio of greater than 1.045 such that the displayed image has good contrast. It can be seen that both the used functions and the remaining function include z coefficients, and each segment time is equally divided into z sequential time slots.

FIG. 9 shows column matrices used for driving columns of the display during the frame duration. During each segment time, a different column matrix, comprising z rows of transformed image data values, is applied to the columns of the display. As described above, during each segment time, the rows of the current column matrix drive the columns of the display during the z sequential time slots into which the segment time is divided. As shown in FIG. 9, only a single column matrix is needed during any segment time. Therefore, only a portion of the column values, rather than the entire set of values for the entire frame duration, is stored during any one time, thus advantageously reducing the amount of memory needed for storage of the column values.

Figure 10:
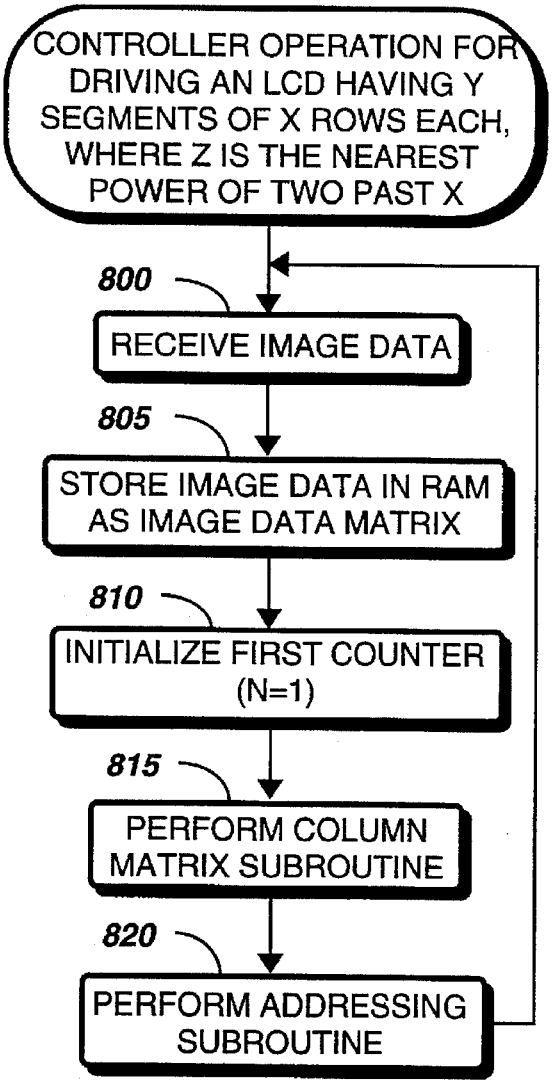
FIGS. 10–12 are flowcharts illustrating the operation of a controller included in the electronic device of FIG. 6 when driving a liquid crystal display, the rows of which are divided into segments, in accordance with the present invention.
Figure 11:
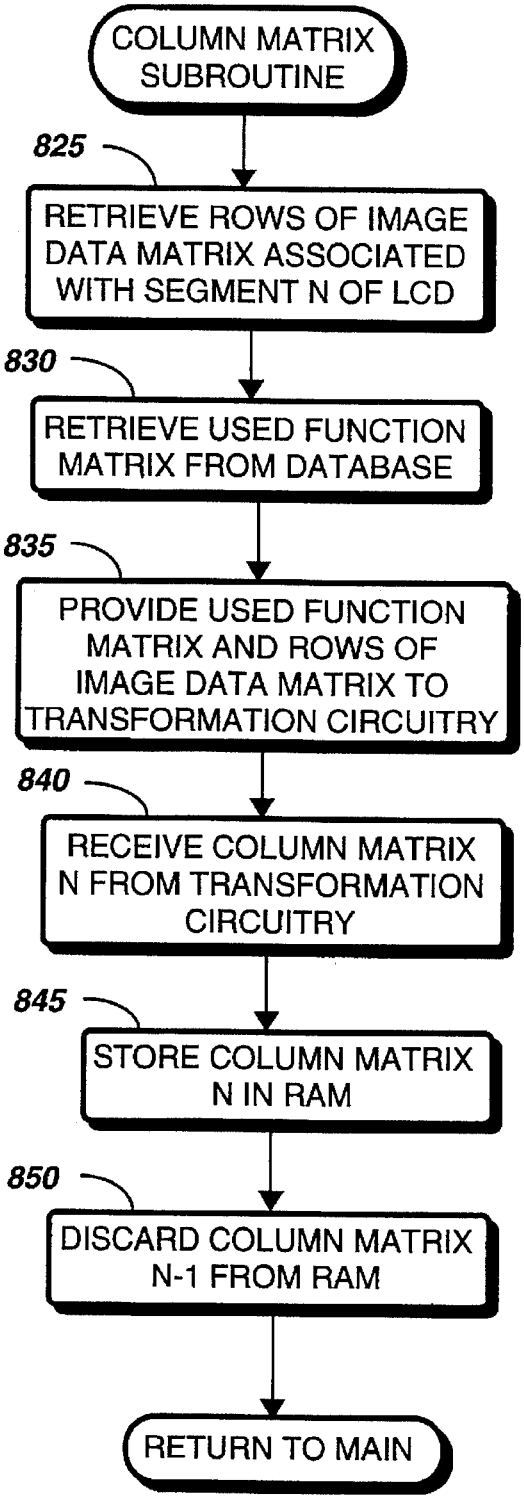
Figure 12:
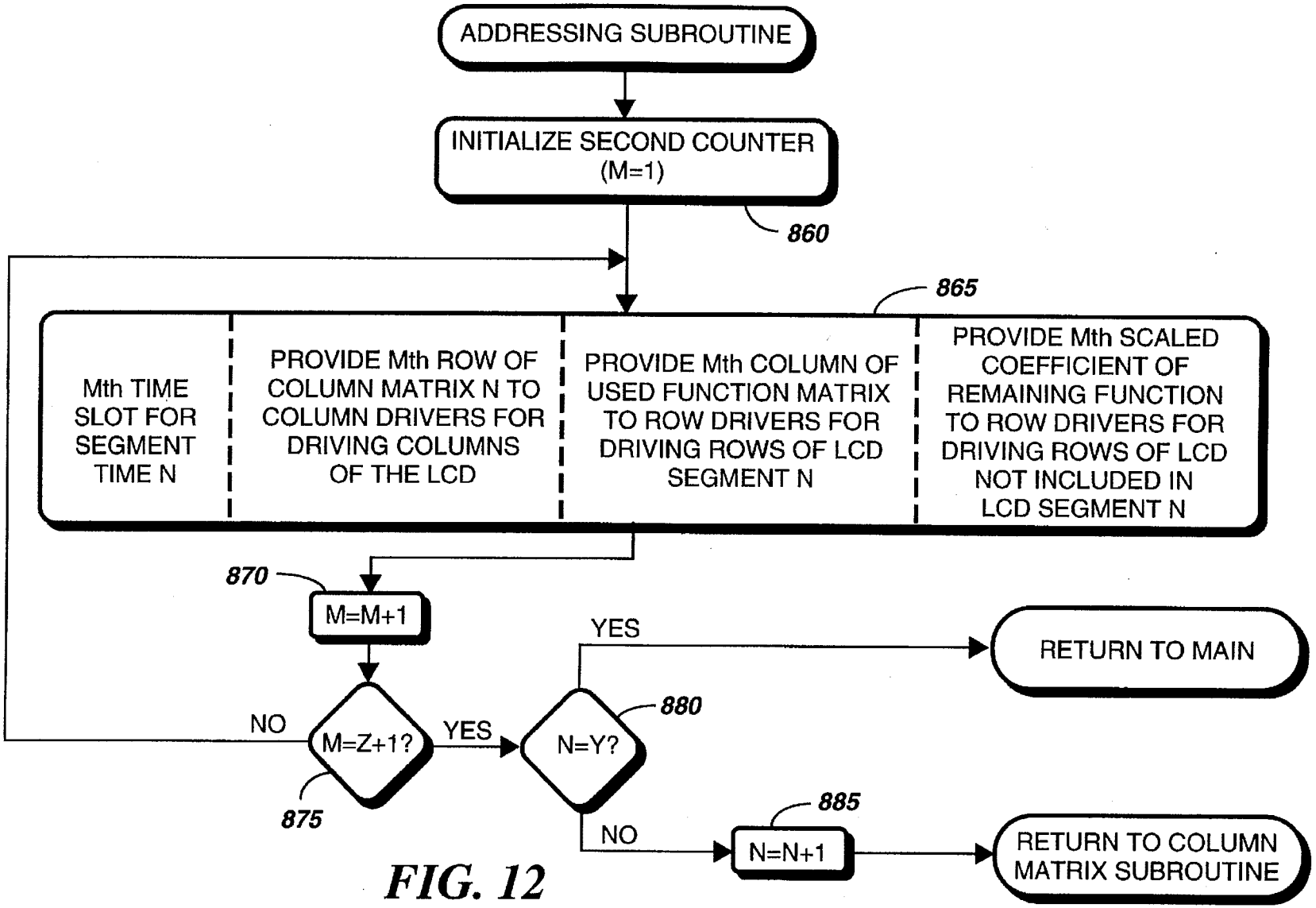

This operation may be better understood by referring to FIGS. 10–12, which are flowcharts illustrating the operation of the controller 615 (FIG. 6) when driving the LCD 600 in accordance with the present invention, wherein the LCD 600 comprises y segments of x rows each. Preferably, the controller 615, at step 800 (FIG. 10), receives from the receiver 608 image data which is stored, at step 805, in the RAM 630 in the form of an image data matrix. In response to reception and storage of the image data, the controller 615 initializes, at step 810, the counter 632, which sets counter value N equal to one, i.e., N=1. Thereafter, the controller 615, at steps 815, 820, performs column matrix subroutines and addressing subroutines for displaying the image data on the LCD 600.

Referring to FIG. 11, the column matrix subroutine begins at step 825, when the controller 615 retrieves rows of the image data matrix which correspond to rows of the LCD 600 included in sediment N (segment 1, at this point). Additionally, the controller 615 retrieves, at step 830, the used function matrix from the orthonormal function database 635 (FIG. 6). The rows of the image data matrix and the used function matrix are provided, at step 835, to the transformation circuitry 640, in response to which the transformation circuitry 640 transforms the rows of the image data matrix to generate a column matrix having z rows, wherein z is the nearest power of two greater than x. At steps 840, 845, the controller 615 receives and stores column matrix N (column matrix 1) in the RAM 630. At this time, any previous column matrix can be conveniently discarded, at step 850, from the RAM 630.

FIG. 12 depicts the addressing subroutine which is next performed. At step 860, the controller 615 initializes the counter 634, which sets counter value M to one, i.e., M=1, subsequent to which the rows and columns of the LCD 600 are addressed at step 865. Step 865 shows the operations performed during the Mth time slot of segment time N, which, for the current counter values M and N, is the 1st time slot of segment time 1. During this first time slot, the Mth (1st) row of column matrix N (column matrix 1) is provided to the column drivers 648 (FIG. 6) for driving the columns of the LCD 600. Additionally, the Mth (1st) column of the used function matrix is provided to the row drivers 650 for driving the rows of the LCD 600 included in segment N (segment 1). The rows of the LCD 600 which are not included in segment N (segment 1) are driven with the Mth (1st) scaled coefficient of the remaining function. Thereafter, at step 870, counter value M is incremented, i.e., M=M+1. The controller 615 then determines, at step 875, whether M=(z+1), i.e., whether all of the sequential time slots included in the current segment time have occurred. When the value of M indicates that the all of the sequential time slots have not occurred, step 865 is repeated for the next Mth (2nd) time slot of segment time N (segment time 1). During this time slot, the column drivers 648 are provided with the Mth (2nd) row of column matrix N (column matrix 1). The row drivers 650 are provided with the Mth (2nd) column of the used function matrix for driving the rows included in segment N (segment 1) of the LCD 600. Additionally, the row drivers 650 are provided with the Mth (2nd) scaled coefficient of the remaining function for driving all rows of the LCD 600 which are not included in segment N (segment 1). Next, at step 870, counter value M is again incremented, i.e., M=M+1. This operation continues until, at step 875, the rows and columns have been addressed for all z sequential time slots included in the current segment time.

When all sequential time slots within the current segment time have occurred, the controller 615 determines, at step 880, whether all of the segment times within the frame duration have occurred, i.e., whether N=y. When the value of N indicates that all of the segment times have not occurred, the counter value N is incremented, i.e., N=N+1, at step 885, and the operation of the controller 615 resumes at step 825 of the column matrix subroutine (FIG. 11).

The column matrix subroutine is thereafter repeated for N=2, resulting in the generation and storage, at step 845, of a second column matrix (column matrix 2) in the RAM 630, and the removal of column matrix 1 from the RAM 630, at step 850. Subsequently, the addressing subroutine is repeated for all of the z sequential time slots included in the second segment time. During this second segment time, at step 865, the columns of the LCD 600 are sequentially addressed with the z rows of column matrix N (column matrix 2), and the rows of the LCD 600 included in segment N (segment 2) are driven with the z columns of the unused function matrix. Additionally, the rows of the LCD 600 which are not included in segment N (segment 2) are successively driven with the z scaled coefficients of the remaining function. This cyclical operation continues until N=y, i.e., all of the segment times have occurred, signifying the end of the frame duration.

In summary, the addressing method described above is employed to drive LCDs which have been divided into a plurality of segments, each having an equal number of rows, wherein the number of rows is preferably not equal to power of two. During each segment time, i.e., the frame duration divided by the number of segments, the columns of the LCD are driven with a column matrix derived by transforming a single subset of the image data. This column matrix includes a number of rows equal to the nearest power of two greater than the number of rows in each segment. At the same time, the rows included in the segment of the LCD associated with the current segment time is driven with a specific set of orthonormal functions, while the other rows are driven with scaled coefficients of a remaining orthonormal function not included in the set. As the segment times sequentially occur, each previous column matrix is discarded, and a next column matrix is generated, stored, and applied to the columns of the LCD.

In this manner, only a single, reduced-size column matrix need be stored in memory at any one time. As a result, the memory of an electronic device according to the present invention can be much smaller than in devices which utilize conventional reduced line addressing techniques. In conventional display devices, a column matrix for addressing the columns during the entire frame time must be calculated and stored for the entire frame time. This column matrix comprises a number of rows equal to the number of rows included in the entire display, and therefore can be quite large. For example, a display having two-hundred-forty rows would require storage of a column matrix comprising two-hundred-forty rows of transformed data for the entire frame period. It can be seen, therefore, that the addressing method according to the present invention requires the use of much less space in memory than do conventional addressing methods.

It will be appreciated by now that there has been provided a method and apparatus for reducing the amount of memory required for storage of signals utilized for driving active-addressed displays.

What is claimed is:

1. A method for driving a display, rows of which are divided into at least first and second segments, the method comprising the steps of:

driving a first plurality of rows included in the first segment with first voltages associated with a first subset of functions included in a complete set of orthonormal functions; and driving a second plurality of rows included in the second segment with second voltages associated with a remaining function included in the complete set of orthonormal functions, wherein the remaining function is not included in the first subset of functions, and wherein the remaining function is not constant, wherein, together at a same first time, the first plurality of rows is driven with the first voltages when the second plurality of rows is driven with the second voltages.

2. The method according to claim 1, further comprising the steps of:

driving the second plurality of rows included in the second segment with the first voltages associated with the first subset of functions; and driving the first plurality of rows included in the first segment with the second voltages associated with the remaining function, wherein, together at a same second time different than the first time, the second plurality of rows is driven with the first voltages when the first plurality of rows is driven with the second voltages.

3. The method according to claim 1, further comprising, prior to the step of driving the second plurality of rows at the first time, the step of:

dividing coefficients of the remaining function by a scaling factor determined by the number of rows included in the first and second segments.

4. The method according to claim 3, further comprising, prior to the step of driving the first plurality of rows at the second time, the step of:

dividing the coefficients of the remaining function by the scaling factor.

5. The method according to claim 2, further comprising the steps of:

transforming, prior to the steps of driving the first and second pluralities of rows together at the first time, a first subset of received image data utilizing a second subset of functions included in the complete set of orthonormal functions, thereby generating a first set of transformed image data; and driving, at the first time, columns of the display with third voltages associated with the first set of transformed image data.

6. The method according to claim 5, further comprising the steps of:

storing, subsequent to the transforming step, the first set of transformed image data in memory; and discarding, subsequent to the step of driving the columns at the first times, the first set of transformed image data from the memory.

7. The method according to claim 6, further comprising the steps of:

transforming, prior to the steps of driving the first and second pluralities of rows together at the second time, a second subset of received image data utilizing the second subset of functions, thereby generating a second set of transformed image data, wherein the second subset of received image data and the first subset of received image data are mutually exclusive of each other; and storing, subsequent to the discarding step, the second set of transformed image data in the memory; and driving, at the second time, the columns of the display with fourth voltages associated with the second set of transformed image data.

8. The method according to claim 7, further comprising the step of:

discarding, subsequent to the step of driving the columns at the second time, the second set of transformed image data from the memory.

9. The method according to claim 7, wherein the steps of transforming the first and second subsets of received image data comprise the step of:

transforming the first and second subsets of received image data by performing Walsh Transforms utilizing the second subset of functions, wherein the second subset of functions and the complete set of orthonormal functions in which the second subset of functions is included are Walsh functions.

10. An electronic device having a display for displaying images and a memory for storing a set of image data, wherein rows of the display are divided into at least first and second segments, the electronic device comprising:

first row driving means for driving a first plurality of rows included in the first segment with first voltages associated with a first subset of orthonormal functions; and second row driving means coupled to the first row driving means for driving a second plurality of rows included in the second segment with second voltages associated with a remaining orthonormal function which is not included in the first subset of functions and which is not constant, wherein, together at a same first time, the first plurality of rows is driven with the first voltages when the second plurality of rows is driven with the second voltages.

11. The electronic device according to claim 10, further comprising:

third row driving means coupled to the first row driving means for driving the second plurality of rows included in the second segment with the first voltages associated with the first subset of orthonormal functions; and fourth row driving means coupled to the third row driving means for driving the first plurality of rows included in the first segment with the second voltages associated with the remaining orthonormal function, wherein, together during a same second time different than the first time, the second plurality of rows is driven with the first voltages when the first plurality of rows is driven with the second voltages.

12. The electronic device according to claim 11, wherein coefficients of the remaining orthonormal function have been divided by a scaling factor determined by the number of rows included in the first and second segments.

13. The electronic device according to claim 11, further comprising timing circuitry for generating timing values.

14. The electronic device according to claim 11, further comprising:

first transforming means for transforming a first subset of image data included in the set of image data utilizing a second subset of orthonormal functions, thereby generating a first set of transformed image data;

first storing means coupled to the first transforming means and the memory for storing the first set of transformed image data in the memory prior to the first time; and first column driving means for driving, at the first time, columns of the display with third voltages associated with the first set of transformed image data.

15. The electronic device according to claim 14, further comprising discarding means coupled to the memory for discarding the first set of transformed image data from the memory subsequent to the first column driving means driving the columns at the first time.

16. The electronic device according to claim 15, further comprising:

second transforming means for transforming a second subset of image data included in the set of image data utilizing the second subset of orthonormal functions, thereby generating a second set of transformed image data, wherein the first and second subsets of image data are mutually exclusive of each other;

second storing means coupled to the second transforming means and the memory for storing the second set of transformed image data in the memory prior to the second time and subsequent to the discarding means discarding the first set of transformed image data from the memory; and second column driving means for driving, at the second time, the columns of the display with fourth voltages associated with the second set of transformed image data.

17. The electronic device according to claim 16, wherein the first and second transforming means comprise transformation circuitry for transforming the first and second subsets of image data by performing Walsh Transforms utilizing the second subset of orthonormal functions, wherein the first and second subsets of orthonormal functions and the remaining orthonormal function are included in a complete set of Walsh functions.

18. The electronic device according to claim 16, wherein:

the first, second, third, and fourth row driving means comprise row drivers coupled to the display for driving the rows of the display; and the first and second column driving means comprise column drivers coupled to the display for driving the columns of the display.

19. The electronic device according to claim 16, wherein the storing and discarding means comprise a controller coupled to the memory for controlling the operation of the electronic device and for providing information from the memory to the row and column drivers.

20. The electronic device according to claim 19, further comprising a receiver coupled to the controller for receiving and decoding a radio frequency signal to recover the set of image data therefrom.

21. A data communication receiver for receiving and storing a set of image data and for displaying images associated therewith on a display having rows divided into first and second segments, the data communication receiver comprising:

a database for storing a set of orthonormal functions; and row drivers coupled to the database for driving the first segment of the display with first voltages associated with a first subset of orthonormal functions and the second segment of the display with second voltages associated with a remaining function included in the set of orthonormal functions and for driving the first segment with the second voltages associated with the remaining function and the second segment with the first voltages associated with the first subset of orthonormal functions, wherein the remaining function is not constant, wherein, together during a same first time, the first segment is driven with the first voltages when the second segment is driven with the second voltages; and wherein, together during a same second time different than the first time, the first segment is driven with the second voltages when the second segment is driven with the first voltages.

22. The data communication receiver according to claim 21, further comprising:

a receiver for receiving a radio frequency signal and recovering therefrom the set of image data;

transformation circuitry coupled to the database and the receiver for transforming a first subset of image data using a second subset of orthonormal functions, thereby generating a first set of transformed image data, and for transforming a second subset of image data using the second subset of orthonormal functions, thereby generating a second set of transformed image data;

a memory coupled to the transformation circuitry for storing the first set of transformed image data during the first time and for storing the second set of transformed image data during the second time; and column drivers coupled to the memory for driving columns of the display with third voltages associated with the first set of transformed image data at the first time and for driving the columns with fourth voltages associated with the second set of transformed image data at the second time.

* * * * *